US009394502B2

(12) United States Patent
Ward

(10) Patent No.: US 9,394,502 B2
(45) Date of Patent: Jul. 19, 2016

(54) STABLE AQUEOUS SLURRY SUSPENSIONS

(75) Inventor: Irl E. Ward, Bethlehem, PA (US)

(73) Assignee: PPT Research, Inc., Allentown, PA (US)

( * ) Notice: Subject to any disclaimer, the term of this patent is extended or adjusted under 35 U.S.C. 154(b) by 0 days.

(21) Appl. No.: 12/586,507

(22) Filed: Sep. 23, 2009

(65) Prior Publication Data

US 2011/0086786 A1 Apr. 14, 2011

Related U.S. Application Data

(63) Continuation-in-part of application No. 12/079,963, filed on Apr. 28, 2008, now Pat. No. 7,985,719.

(51) Int. Cl.

| | |
|---|---|
| ***C07C 55/02*** | (2006.01) |
| ***C08J 3/02*** | (2006.01) |
| ***C10M 173/02*** | (2006.01) |
| ***C10M 171/00*** | (2006.01) |

(52) U.S. Cl.

CPC ..... *C10M 173/02* (2013.01); *C10M 171/00* (2013.01); *C10M 2201/041* (2013.01); *C10M 2201/061* (2013.01); *C10M 2201/062* (2013.01); *C10M 2201/084* (2013.01); *C10M 2201/105* (2013.01); *C10M 2207/0406* (2013.01); *C10M 2207/046* (2013.01); *C10M 2209/084* (2013.01); *C10M 2209/086* (2013.01); *C10M 2209/104* (2013.01); *C10M 2209/1045* (2013.01); *C10M 2209/1055* (2013.01); *C10M 2209/1065* (2013.01); *C10M 2215/04* (2013.01); *C10M 2221/02* (2013.01); *C10M 2229/041* (2013.01); *C10N 2210/02* (2013.01); *C10N 2210/03* (2013.01); *C10N 2210/04* (2013.01); *C10N 2220/021* (2013.01); *C10N 2220/022* (2013.01); *C10N 2240/401* (2013.01); *C10N 2250/10* (2013.01)

(58) Field of Classification Search

CPC ..... C10M 173/02
USPC ..... 508/506; 516/104, 141
See application file for complete search history.

(56) References Cited

U.S. PATENT DOCUMENTS

| | | | | |
|---|---|---|---|---|
| 6,579,472 | B2 * | 6/2003 | Chung et al. | 252/389.31 |
| 7,381,690 | B1 * | 6/2008 | Ding et al. | 508/137 |
| 2004/0043161 | A1 * | 3/2004 | Sepeur et al. | 427/551 |

* cited by examiner

*Primary Examiner* — Prem C Singh
*Assistant Examiner* — Frank C Campanell
(74) *Attorney, Agent, or Firm* — Sanford J. Piltch

(57) ABSTRACT

A slurry composition for use as a lubricant and/or a stable suspension medium to suspend inert organic or inorganic particles which is an aqueous or polar solvent carrier containing gel particles as a lubricating and suspending agent for inert organic or inorganic particles. The composition can contain inorganic salts to provide additional electrostatic repulsion.

20 Claims, No Drawings

STABLE AQUEOUS SLURRY SUSPENSIONS

RELATED APPLICATIONS

This application is a continuation-in-part of application Ser. No. 12/079,963 of Ward filed Apr. 28, 2008 now U.S. Pat. No. 7,985,719.

FIELD OF THE INVENTION

The present invention relates to sol or gel particles alone or within a liquid media as a suspension medium. More particularly there is provided a carrier system that possesses long term dispersion stability characteristics for particle suspensions, which have uses with a large range of inert particles that can be suspended including abrasive, non-abrasive, inert solid organic particles, ceramic particles, and the like.

BACKGROUND OF THE INVENTION

Non-aqueous, semi-aqueous and aqueous suspensions of non-colloidal high density abrasive particles have been previously used in wire saw cutting and lapping of wafers but have been unsuccessful in obtaining a stable slurry suspension. U.S. Pat. No. 5,099,820 issued to Stricot discloses an abrasive slurry of a suspension of silicon carbide particles in water or oil. However, the suspensions are not stable and do not provide uniform lubrication and cutting by the wires. Such compositions require vigorous agitation to maintain a uniform suspension of particles, and the suspensions settles out quickly under stagnant conditions even during workpiece slicing while still under agitation.

U.S. Pat. No. 6,602,834 to Ward et al which is herein incorporated by reference, discloses a non-aqueous or semi-aqueous cutting and lubricating composition for use with wire saws that relies upon a surfactant, an organic polyelectrolyte and pH to provide electrostatic repulsion and particle-particle interference to maintain a stable suspension of abrasive particles.

U.S. Pat. No. 6,054,422 to Ward et al discloses a lubricating composition containing up to 70 weight percent abrasive grit material in a suspension utilizing a mixture of high and low molecular weight polyalkylene glycols as a suspension agent.

In the production of Silicon, SiC, Sapphire, GaAs, optical glass, and other wafers used in a variety of industries (i.e., Microelectronics, Solar Cells, L.E.D.'s, broad band-width devices, optics/lasers, wafer polishing, CMP applications, many others) wafers are cut from larger ingots, bricks, boules, etc. The next step following the initial cut of the wafer, disc, piece, etc., involves the LAPPING of the cut wafer to smooth out the surface, lower the TTV (ie; Total Thickness Variation), eliminate damage depth defects and prepare the wafer for final "POLISHING". In general, aqueous carriers are used as the suspension media for the lapping abrasives employed in this step. Lapping abrasives can include, but are not limited to: SiC, Aluminum oxides, $ZrO_2$, Silicas, $CeO_2$, diamond, etc. Lapping slurries utilize abrasive particles that are in the size range of about 0.5-10 μm. This means that the suspended abrasive particles are typically non-colloidal in size and nature. This does not exclude the use of colloidal lapping abrasive (i.e. abrasive particles of size range from about 0.001-1.0 um), but such particles are not typically used in lapping slurries.

The lapping slurry for wafers, gears, ceramic, etc., is subjected to many shear, grinding, and abrasive forces during the wafer lapping process. During the process of "planetary lapping", the slurry is injected onto the wafer surface, which is held between two large metal (ie; typically iron and/or steel) plates. Counter rotation of the upper and lower plates holding the wafer compresses the slurry between the upper plate and the wafer surface. The solids within the compressed slurry contact the wafer, and angular momentum, causes the abrasive action to remove surface wafer defects and "etch" away the desired amount of wafer surface material. With all aqueous slurries used today in lapping, such action on the slurry and the design of the lapping equipment propagates particle agglomeration on the wafer, within the reservoir, within the feed piping, within the lapper, on the iron plates, etc. Such particle agglomeration has the added deleterious effect of producing damaging "scratches" on the lapped wafer. Such wafers must then be discarded at great cost.

Aqueous suspension of non-colloidal (i.e. NCOL), high-density abrasive particles has been a severe and debilitating problem for "wafer" manufacturers for several decades. To date, there exists no low viscosity, water-based carrier that will maintain "NCOL" abrasive particle suspension for more than an extremely short time period of a few to several minutes. After that, particles begin to agglomerate and settle out of suspension quickly to the bottom of the container. Such abrasive particle settling in current "aqueous" slurries occurs quickly, even during constant mixing or recirculation. This particle settling is typically manifested by a "hard settled cake" at the bottom of the container. Any attempt to regenerate slurry, which would maintain the original particle size distribution of the virgin abrasive, cannot be accomplished by simple mixing, agitation, shaking or the like. As a result, such slurries are immediately discarded, wasting expensive abrasive, time, manpower, and effort.

In prior art suspensions, temperature and pH played a factor in the amount of time that a suspension remains homogenous and uniform in extended stagnant storage. Inorganic particles may remain in suspension in aqueous and non-aqueous solvents depending upon the size of the particle, lattice structure and density but in stagnant storage tend to agglomerate and settle out of suspension.

Also, there are no custom made suspending media. Suspending agents remain in the same medium which they are formed.

SUMMARY OF THE INVENTION

The present invention relates to the suspension of particles in a carrier and to sol-gels or gel particles which can be used alone or in an organic or aqueous medium to suspend solid inert particles. Gel particles that include sols, sol-gels, gel particles, gelatinous precipitates, etc., (hereinafter "gel particles") are used to suspend inert particles and to act as lubricants in a variety of applications as particles alone or in a liquid medium. The suspension slurry composition formed can contain gel particles in amount ranging from about 0.1% up to about 80% of the carrier by weight. The gel particles and base carrier may be used without the addition of other suspended particles as a lubricant. The aqueous content of the carrier can contain about 1 to 100% by weight of water with an organic solvent added for any carrier less than 100% water. The organic medium can comprise a variety of solvents, preferably alkylene and polyalkylene glycols depending upon use.

The gel particles which are preferably aluminum hydroxide ($Al(OH)_3$) can be created in an aqueous, non-aqueous or aqueous organic medium, separated and transferred to a second medium, whether aqueous or non-aqueous or used alone in a variety of cases required as a lubricant or to custom formulate a suspension or slurry of abrasive or non-abrasive particles.

However, gel particles can be formed with other metal oxides, metal sulfides, hydroxides, and oxide hydrates that can form a suspended precipitate in water within the pH of about 3 to 12.

It is a general object of the invention to provide long-term stable slurry suspensions which can be used in wire saw applications for cutting slices from ingots, lapping applications, CMP applications, and in the separation of particles.

It is another object of the invention to provide a long-term stable suspension of abrasive or non-abrasive particles in a low toxicity and/or low viscosity carrier.

It is yet another object of the invention to provide a stable suspension of colloidal or NCOL abrasive or non-abrasive particles in a neutral or near neutral pH medium.

A further object of the invention is to provide a means for suspending colloidal or NCOL abrasive or other particles in a liquid not depending upon final slurry viscosity.

Another object of the invention is to provide gel particles which can be added to a variety of base carriers to suspend inert particles and also act as lubricants.

DESCRIPTION OF THE PREFERRED EMBODIMENTS

The present invention provides a means for providing a stable suspension of particles in an aqueous or organic medium or semi-aqueous medium without agglomeration or particle hard settling utilizing sol-gels or gel particles. According to one feature of the invention there is provided suspension and/or lubricating carriers and slurry compositions for wire saw applications as lubricants; lapping or polishing slurries, non-abrasive slurries and the like in which a suspension of particles is maintained at ambient as well as elevated temperature. The gel particles are maintained as an aqueous, semi-aqueous or non-aqueous suspension in about 0.1 to 80 weight percent of carrier.

The gel particles can be prepared separately and then used alone or in a carrier as a lubricant and/or suspension agent or combined with a polar or non-polar solvent. The gel particles can advantageously be used in different types of glycols so that the lubricating compositions can be custom made for a particular use.

It is desirable in many cases to use more than one suspending agent in order to have a uniform dispersion for as long as possible. The reason for this is that the particles to be suspended may have different densities and/or electrostatic charges from the suspending gel particles. For example, in wire saw cutting operations there are cutting particles and kerf particles from the ingot being cut. In other operations there can be contaminants with higher density or similar density as the suspending medium.

These suspending particles are metal or semi-metal oxides, hydroxides and oxide hydrates that form a suspended particulate precipitate (i.e., sols, sol-gels, gel particles, gelatinous precipitate etc.) in aqueous, semi-aqueous or non-aqueous media at a pH from about 3 to 12. The particles to be suspended comprise the conventional abrasive or non-abrasive particles, inert particles having a particle size of about 1 to 100 μm for pigment manufacture, wire saw cutting, metal finishing applications and smaller size for wafer lapping applications being in the range typically of about 0.1 to 10 μm and even lower for CMP applications the particles being the range of about 10-500 nm. The preferred suspending particles are those formed in situ or separately such as when a metal salt is formed into the metal hydroxide. In such a case, the density of the in-situ prepared precipitated gel particles is generally lower and the surface area of the gel particle formed in-situ is typically greater than commercially available forms. In addition, there is generally a broader particle size distribution of the in-situ formed gel particles of the invention. The advantage of having the gel particles separate from the carrier medium allows for mixing different particle sizes in certain applications particularly for coating.

The abrasive material for use in the above-recited composition may include powders of diamond, silica, tungsten carbide, silicon carbide, boron carbide, silicon nitride, silicon dioxide, titanium dioxide, cerium oxide, zirconium oxide, aluminum oxide, or other hard grit abrasive or non-abrasive "powder" material. Generally, mean or average particle sizes range from about 0.5-30 microns and preferably from about 2-20 microns, or a mixture thereof. The concentrations of the inert particles being suspended in the suspension medium or carrier for most applications typically may range from about 0.1 to 60 weight percent of the total suspension.

Solvents which may be used with the water are polar solvents which include alcohols, amides, esters, ethers, ketones, glycols, glycol ethers, alkyl lactones, or sulfoxides. Specifically, examples of polar solvents are dimethyl sulfoxide (DMSO), dimethylacetamide (DMAC), N-methylpyrrolidone (NMP), (gamma) butyrolactone, diethylene glycol ethyl ether, dipropylene glycol methyl ether, tripropylene glycol monomethyl ether, various glycols, polyethylene glycols and poly propylene glycols and the like.

The organic solvents are used in some cases to provide needed viscosity levels to the resulting slurries prepared. Other uses for organic solvents may include a lowering of the slurry/carrier freezing point. The choice of the solvent is relatively immaterial as long as the solvent is inert, fully miserable or soluble in water, non-reactive with water or with the suspended particles or suspending gel particles, and has low toxicity and is of low odor.

The suspending particles that can be used include, but are not limited to, metal hydroxides, oxide hydrates and oxides other than the abrasive particles that form an aqueous or semi-aqueous suspension (i.e. gel particles, gelatinous precipitate, sol, sol-gels, colloidal or non-colloidal suspension, etc.). These suspending particles as an important component of the present invention will not settle out over time to form a hard agglomerate on the container bottom. This includes, but is not limited to those compounds, which in-situ are within or without the medium converted to the hydroxide form such as a metal sulfate that is converted to the hydroxide form using a metal or non-metal Bronstead base, for example, potassium hydroxide, tetramethyl ammonium hydroxide, sodium hydroxide, tetraethylammonium hydroxide, barium hydroxide, etc. as illustrated by the following example equation:

$$Al_2(SO_4)_3+6[CH_4N]OH^{water}\rightarrow 2Al(OH)_3+3[(CH_3)_4N]_2(SO_4)$$

Among the suitable metal hydroxides of use in this invention include, but are not limited to cupric hydroxide, aluminum hydroxide, and $Zn(OH)_2$.

Among the metal oxides, sulfides, salts or oxide hydrates which may be used to form or form in-situ the suspending particles are transition metal oxides such as nickel oxides, ZnO, Zn-salts, ZnS, $SnO_2xH_2O$, tin-salts, SnS, $Al_2O_3.xH_2O$, Al-salts and the like. These oxides, salts, sulfides and the like can also be used to form the corresponding hydroxides to provide a stable suspension medium that includes sol-gels, gel particles, gelatinous colloidal or non-colloidal suspension for the carrier system.

In the case of $Al(OH)_3$ or other aluminum oxide or hydroxide species, a pH range for use in the carrier is about 3-12. A preferred range is 5-10 and the most preferred range is 6-9.

Excluded as suspending precipitates or particles are those particles having a density significantly greater than that of the carrier solvent, and those that are not naturally precipitous or suspend-able. It is understood that there are those metal oxides or hydroxides which have a higher density except when formed or precipitated in-situ in the carrier solvent or in another medium which is then added to the carrier systems of this invention.

A corrosion inhibitor may be added to the carrier formulations of the present invention to suppress or eliminate metal corrosion when required. Appropriate inhibitors should not cause foaming, interfere with the formulations' ability to provide long-term stable abrasive or solids suspensions, compromise the viscosity, rheology, or uniformity of the carrier formulations and their associated abrasive or solids suspensions.

Suitable corrosion inhibitors which may be added to the aqueous and semi-aqueous carriers of the present invention may include, but are not limited to aliphatic and aromatic carboxylic acids, neutralized carboxylic acids using alkanol amines (i.e. diethanol amine, triethanol amine, etc.), tetra-alkylammonium hydroxides, other similar non-metal hydroxide bases, alkyl or aromatic amines or other Bronstead bases. Also included may be other known metal corrosion inhibitors in the art such as long chain modified carboxylates commercially under such trade names as DeForest DeCore-APCI-95, DeTrope CA-100. Further examples of known corrosion inhibitors equally suitable for the corrosion prevention or suppression of metals used in CMP processes (i.e. Al/Cu, Cu, Al/Si, Al/Si/Cu, GaAs, LnP, and the like) may include but are not limited to benzoic acid, pyrogallol, gallic acid, ammonium thiosulfate, 8-hydroxy quinoline, catachol, benzotrizole, etc., or combinations thereof.

Additionally, there are other suitable corrosion inhibitors which function as oxygen absorbers or scavengers which include but are not limited to hydroquinone poly-hydroxy aromatics, 8-hydroxyquinoline, nitrites, sulfites, etc.

The selection of the corrosion inhibitors for the purpose of this invention is immaterial as long as the inhibitor meets the above mentioned performance criteria including:

- suppress or eliminate metal corrosion
- does not cause noticeable foaming of the carrier or resulting slurry
- does not compromise or interfere with the ability of the carrier to provide long-term stability of the slurry
- does not deleteriously effect viscosity, performance or rheology of the carrier or resulting gel particle or inert solids suspension
- does not deleteriously effect the uniformity or homogeneity of the carrier suspension or the gel particle or inert solids suspension within the carrier
- does not chemically react with either the base medium or the gel particles of the carrier or the inert particles as a slurry being suspended by the gel particles.

Certain of the salts which are generated as a by-product of the reaction to form the gel particles may appropriately increase the ionic strength so as to aid in the repulsion and increase the settling time of the suspended inert particles given the right concentration and structure of said generated salt. However, it may also be advantageous to rinse out the generated dissolved salt formed during the gel particle formation, depending upon the application of the overall slurry suspension, leaving only the in-situ formed gel particles in the base medium, preferably water.

Certain inert salts may be useful in suspending particles when the gel particles have been separated and added to different carrier liquids so as to provide electrostatic repulsion and particle-particle interference given an appropriate concentration of the inert salt that will increase particle-particle repulsion.

The following examples are illustrative of the practice of the method of the present invention. It will be understood, however, that the listed examples are not to be construed in any way limitative of the full scope of the invention since various changes contained herein in light of the guiding principles which have been set forth above. All percentages stated herein are based on weight except where otherwise indicated.

Example 1

A. Preparation of Gel Particles

A 0.5 M aqueous solution of aluminum sulfate octadecahydrate was added to tap water so that the percent aluminum sulfate in the water was 0.94%. This solution was neutralized with a 0.5 M solution of tetramethyl ammonium hydroxide (TMAH) to a pH of 7.5 under constant mixing over a time period of 25 minutes. The resulting $Al(OH)_3$ gel particles appear as a white cloudy suspension. The suspension is then rinsed with water 3-times to remove dissolved by-product salt in the suspension. The resulting carrier suspension has very low or no ionic character/properties.

B. The gel particles of Part A were filtered and added to an aqueous carrier containing titanium oxide for use as a coating composition containing 50% of the gel particles.

Example 2

A. Preparation of Gel Particles

Solid aluminum sulfate octadecahydrate was added to tap water so that the concentration of aluminum sulfate in water was 10.7%. This solution was slowly and uniformly neutralized under constant mixing with NaOH (50% solution in water) to a pH of 8.4. The in-situ formed gel particles appear as a white cloudy suspension within the water base.

B. Preparation of Suspension Slurry of Abrasive Particles

A slurry of ~15% abrasive SiC particles of mean particle size ~10 μm is suspended within the gel particle carrier prepared in (A) above. The suspension is thoroughly mixed and let stand under both ambient and elevated temperature conditions to determine the soft-settle and suspension uniformity characteristics. The formulation, viscosity, soft settle reading (SSR) and suspension volume retention (SVR) data are listed in the following tables. Again the SSR and SVR readings demonstrate an excellent stable particle suspension, even after 4 weeks.

TABLE 2

| Viscosity, SSR, and SVR | | | | | | | | | | |
|---|---|---|---|---|---|---|---|---|---|---|
| | Viscosity at 25° | | Ambient Soft Settle & SVR | | | | 50° C. Soft Settle & SVR | | | |
| % Solid | (cP) | | Day 1 | | Week 4 | | Day 1 | | Week 4 | |
| $Al_2(SO_4)_3$ | Carrier | Slurry | SVR | SSR | SVR | SSR | SVR | SSR | SVR | SSR |
| 10.76 | 16.0 | 74.0 | 66 | 0 | 42 | 0 | 56 | 0 | 51 | 0 |

Example 3

Solid aluminum sulfate octadecahydrate was added to tap water so that the concentration of aluminum sulfate in water was 15.54%. This solution was neutralized with KOH (25% solution in water) to a pH of 7.7. To this white cloudy carrier system is added 48% by weight of SiC particles of average size ~8-9 p.m. The entire suspended slurry is mixed thoroughly for ~5 min. The formulation, viscosity, SSR, and SVR data are listed in the following tables. Similar results in terms of slurry stability to those of previous examples were observed. However, in this example, the SVR of 74 after 4 weeks @ 50° C. illustrates an exceptionally stable slurry.

TABLE 3

| Viscosity, SSR and SVR Data | | | | | | | | | | |
|---|---|---|---|---|---|---|---|---|---|---|
| | Viscosity at 25° | | Ambient Soft Settle & SVR of Slurry | | | | 50° C. Soft Settle & SVR of Slurry | | | |
| % Solid | (cP) | | Day 1 | | Week 4 | | Day 1 | | Week 4 | |
| $Al_2(SO_4)_3$ | Carrier | Slurry | SVR | SSR | SVR | SSR | SVR | SSR | SVR | SSR |
| 15.54 | 29.4 | 236.5 | 71 | 0 | 58 | 0 | 71 | 0 | 74 | 0 |

In lieu of aluminum sulfate, Zinc sulfate or stannous sulfate can be used. The gels which are formed can be filtered and mixed to be used in different liquid mediums. Inert salts may be added to provide additional electrostatic repulsion of particles. Also, dissolved salt created by the gel particle formation may be rinsed out with water or the appropriate carrier medium solvent to create a gel particle suspension with comparatively little or no ionic character.

Example 4

A. Preparation of Gel Particles

In this example, instead of using tap water as the solvent, a semi-aqueous solvent employing propylene glycol methyl ether (PGME), was used. Because stannous sulfate is not sufficiently soluble in PGME, a water solution of stannous sulfate is prepared within which the $Sn(OH)_2$ gel particles are prepared before it is added to the PGME. In this case, a 0.5 M solution of stannous sulfate was prepared and neutralized with sufficient 25% aqueous TMAH to give a pH of 7.9. The gel particles were filtered and the wet gel solids were stored for 4 weeks under closed conditions to maintain the water content within the wet gel solids.

B. The wet gel particles were then added to a 2:1 mixture of PGME; water so as to be 50% of the total mixture. To the mixture was added titanium dioxide in equal amounts of weight as the gel particles to form a coating composition.

An appropriate amount of tetramethylammonium sulfate may be added to provide additional electrostatic repulsion between suspended particles.

Example 5

The separated gel particles of Example 2-A were combined with enough PEG200 to yield a wet gel-particle concentration of ~30% wt/wt. To this is added sufficient water to dilute the carrier suspension by 25%, 50% and 75% to provide three different gel particle concentrations between the three different dilutions. For this example, the variation in overall pH, SSR and SVR is reported in the table below. 18% zirconium oxide ($ZrO_2$) was added to the mixture consistent with other examples herein, and slurry properties measured. The results of the various dilutions are listed in the following table.

TABLE 5

| Formulation Data (Example 5) | | | | | | |
|---|---|---|---|---|---|---|
| % $Al(OH)_3$ Wet Gel Particles in Carrier | Weight of Carrier from Ex-4 (g) | Weight of Tap Water (g) | % Carrier Dilution | % Gel Particles in Diluted Carrier | pH | SlurrySSR (SVR)after 3 weeks (18% $ZrO_2$) |
| 30 | 140 | 140 | 50 | 15 | 7.77 | 0 (52%) |
| 30 | 140 | 46.7 | 25 | 22.5 | 7.86 | 0 (61%) |
| 30 | 140 | 420 | 75 | 7.5 | 7.43 | 0 (41%) |

What is claimed is:

1. A method for the suspension of inert colloidal or non-colloidal abrasive or non-abrasive particles in a stable aqueous, semi aqueous or non-aqueous organic carrier medium which comprises producing in-situ suspending particles selected from the group consisting of stable gel particles, sol-gel particles and gelatinous precipitates so as to establish an appropriate concentration of suspending particles to inert particles interference to settling of said inert particles in said carrier medium, said carrier medium comprising about 0.1 to 50% by weight of the suspending particles, which differ from said inert particles, and are selected from the group consisting of alkaline metal and transition metal hydroxides, oxy hydroxides, and oxide hydrates that form in-situ said suspending particles within and inclusive of said carrier medium at a pH of about 4 to 10, whereby said inert particles are suspended as a result of at least one of physical interference, density differences, particle size differences and electrostatic charge repulsion.

2. The method of claim 1 wherein said suspending stable gel particles are formed in a separate medium from the final carrier medium.

3. The method of claim 1 wherein said aqueous carrier medium contains at least one inert polar solvent.

4. The method of claim 3 wherein said polar solvent is selected from the group consisting of dialkylene glycol, alkylene glycol, glycol ether, polyalkylene glycol, alkyl lactone, N-methyl pyrrolidone, alkylene carbonates, acetonitrile, and dimethyl acetamide.

5. The method of claim 1 wherein said suspending gel particles, sol gel particles, and gelatinous precipitates are alkaline metal, semi-metal or transition metal hydroxides, oxy hydroxides or oxide hydrates.

6. The method of claim 1 which includes an inert salt to provide further density difference or electrostatic repulsion between suspended particles.

7. The method of claim 1 which includes the removal of inert salt produced by the formation of the suspending particles.

8. The method of claim 5 wherein said suspending particles are formed in situ with the carrier medium.

9. The method of claim 5 wherein said suspending particles are formed from a member selected from the group consisting of aluminum hydroxide, aluminum oxy hydroxide, zinc hydroxide, ferric hydroxide, silicon oxide hydrate, silicon oxy hydroxide, cupric hydroxide, magnesium hydroxide and tin hydroxide.

10. The method of claim 1 wherein said inert particles being suspended are selected from the group consisting of titanium dioxide, silicon carbide, zirconium oxide, silica, cerium oxide, aluminum oxide, silicon nitride, boron carbide, tungsten carbide, diamond, silicon dioxide and dry pigment particles.

11. The method of claim 1 including a corrosion inhibitor.

12. A stable aqueous or semi-aqueous composition for suspending inert colloidal or non-colloidal abrasive or non-abrasive particles for use in an abrading or coating process which comprises in-situ formation of suspending particles selected from the group consisting of stable gel particles, sol gel particles and gelatinous precipitates in an aqueous carrier medium having an appropriate concentration of suspending particles to inert particles sufficient to establish interference to settling of said inert particles in said carrier medium and a pH of about 4 to 10, said suspending particles, which differ from said inert particles, being selected from the group consisting of alkaline metal or transition metal hydroxides, oxy hydroxides and oxide hydrates and are present in said carrier medium at a concentration of 0.1 to 50% by weight, whereby said inert particles are suspended as a result of at least one of physical interference, density differences, particle size differences, and electrostatic charge repulsion.

13. The composition of claim 12 wherein the gel particles, sol-gel particles and gelatinous precipitates are formed in a carrier medium separate from the final carrier medium.

14. The composition of claim 12 comprising a mixture of gel particles.

15. The composition of claim 12 including a corrosion inhibitor.

16. The composition of claim 12 wherein the inert abrasive particles are selected from the group consisting of titanium dioxide, silicon carbide, zirconium oxide, silica, cerium oxide, aluminum oxide, diamond, silicon nitride, tungsten carbide and silicon dioxide.

17. The composition of claim 12 wherein the suspending particles are formed in-situ within the aqueous or semi-aqueous medium to yield a member selected from the group consisting of aluminum hydroxide, aluminum oxy hydroxide, zinc hydroxide, ferric hydroxide, silicon oxide hydrate, silicon oxy hydroxide, cupric hydroxide, magnesium hydroxide, and tin hydroxide.

18. The composition of claim 12 comprising a mixture of different suspending particles.

19. The composition of claim 12 including a polar solvent.

20. The composition of claim 19 wherein said polar solvent is selected from the group consisting of dialkylene glycol, alkylene glycol, glycol ether, polyalkylene glycol, alkyl lactone, N-methyl pyrrolidone, alkylene carbonates, acetonitrile, and dimethyl acetamide.

* * * * *